US009164449B1

(12) United States Patent
Hashimoto et al.

(10) Patent No.: US 9,164,449 B1
(45) Date of Patent: Oct. 20, 2015

(54) IMAGE FORMING APPARATUS

(71) Applicant: FUJI XEROX CO., LTD., Tokyo (JP)

(72) Inventors: Keita Hashimoto, Kanagawa (JP); Yukihiro Ichiki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/686,273

(22) Filed: Apr. 14, 2015

(30) Foreign Application Priority Data

Sep. 22, 2014 (JP) ..... 2014-192620

(51) Int. Cl.
*G03G 15/20* (2006.01)

(52) U.S. Cl.
CPC ..... *G03G 15/2053* (2013.01); *G03G 15/2035* (2013.01)

(58) Field of Classification Search
CPC ..... G03G 15/2053; G03G 2215/00544
See application file for complete search history.

(56) References Cited

U.S. PATENT DOCUMENTS

| | | | | |
|---|---|---|---|---|
| 7,263,311 | B2 * | 8/2007 | Ikeda | 399/122 |
| 2006/0002737 | A1 * | 1/2006 | Shinshi | 399/122 |
| 2009/0148204 | A1 * | 6/2009 | Yoshinaga et al. | 399/328 |

FOREIGN PATENT DOCUMENTS

| | | | |
|---|---|---|---|
| JP | 62-164077 | A | 7/1987 |
| JP | 2007-099408 | A | 4/2007 |
| JP | 2012-238018 | A | 12/2012 |

* cited by examiner

*Primary Examiner* — Sandra Brase
(74) *Attorney, Agent, or Firm* — Sughrue Mion, PLLC

(57) ABSTRACT

An image forming apparatus includes an image forming member; a heating member; an opposing member that opposes the heating member; an urging member having one end attached to a first support member that supports the opposing member, the urging member urging the opposing member so that the opposing member presses a recording medium against the heating member; a moving member that moves from a closed position to an open position, a space accommodating the heating and opposing members being closed when the moving member is at the closed position and opened when the moving member is at the open position; and a cancelling member to which the other end of the urging member is attached and that is rotatably attached to a second support member that supports the heating member, the cancelling member rotating from the closed position to cancel a pressing force with which the recording medium is pressed.

4 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2014-192620 filed Sep. 22, 2014.

BACKGROUND (i) Technical Field

The present invention relates to an image forming apparatus.

(ii) Related Art

In small image forming apparatus, a fixing device is disposed in an upper section of the inner space of a housing. The fixing device includes a heating member and an opposing member that opposes the heating member at an upper side of the heating member and that presses a recording medium against the heating member.

A cancelling member cancels a pressing force of the opposing member in response to an opening-closing operation of an opening-closing member that covers the fixing device. The cancelling member may be rotatably supported by a support member that supports the opposing member. In this case, the cancelling member projects upward from the support member that supports the opposing member. The height of the housing may be determined in consideration of the arrangement of the cancelling member.

SUMMARY

According to an aspect of the invention, there is provided an image forming apparatus including an image forming member that forms an image on a recording medium; a heating member that is disposed in a housing and heats the image formed on the recording medium; an opposing member that opposes the heating member at an upper side of the heating member; an urging member having one end attached to a first support member that supports the opposing member, the urging member urging the opposing member toward the heating member so that the opposing member presses the recording medium against the heating member; a moving member that forms a portion of the housing and moves from a closed position to an open position, a space accommodating the heating member and the opposing member being closed at one side of the housing when the moving member is at the closed position and opened at the one side of the housing when the moving member is at the open position; and a cancelling member to which the other end of the urging member is attached and that is rotatably attached to a second support member that supports the heating member, the cancelling member rotating in response to the movement of the moving member from the closed position to cancel a pressing force with which the opposing member presses the recording medium against the heating member.

BRIEF DESCRIPTION OF THE DRAWINGS

An exemplary embodiment of the present invention will be described in detail based on the following figures, wherein.

DETAILED DESCRIPTION

Figure 1A:
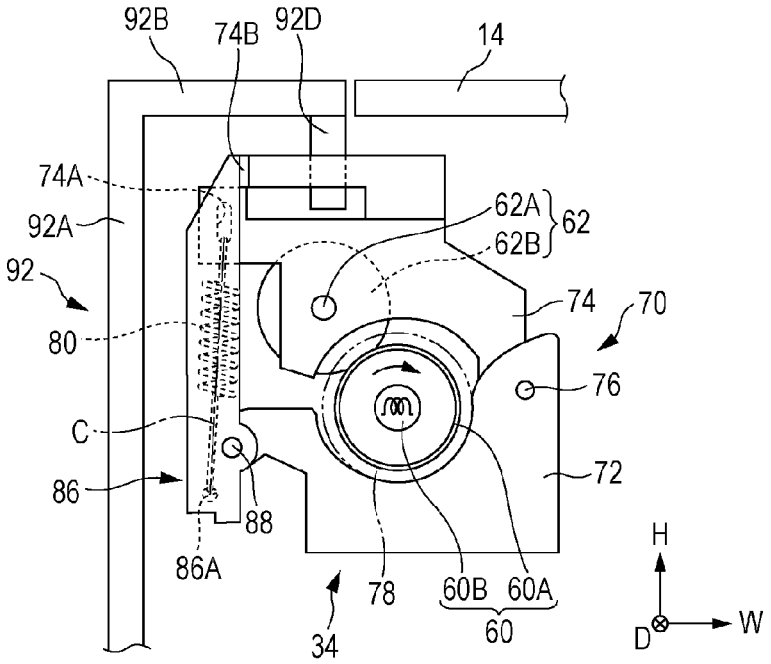
FIGS. 1A and 1B are side views illustrating an opening-closing member, a fixing device, etc., included in an image forming apparatus according to an exemplary embodiment of the present invention.

An image forming apparatus according to an exemplary embodiment of the present invention will be described with reference to FIGS. 1A to 5. In the drawings, the arrow H shows the up-down direction (vertical direction) of the apparatus, the arrow W shows the width direction (horizontal direction) of the apparatus, and the arrow D shows the depth direction (horizontal direction) of the apparatus.

Figure 5:
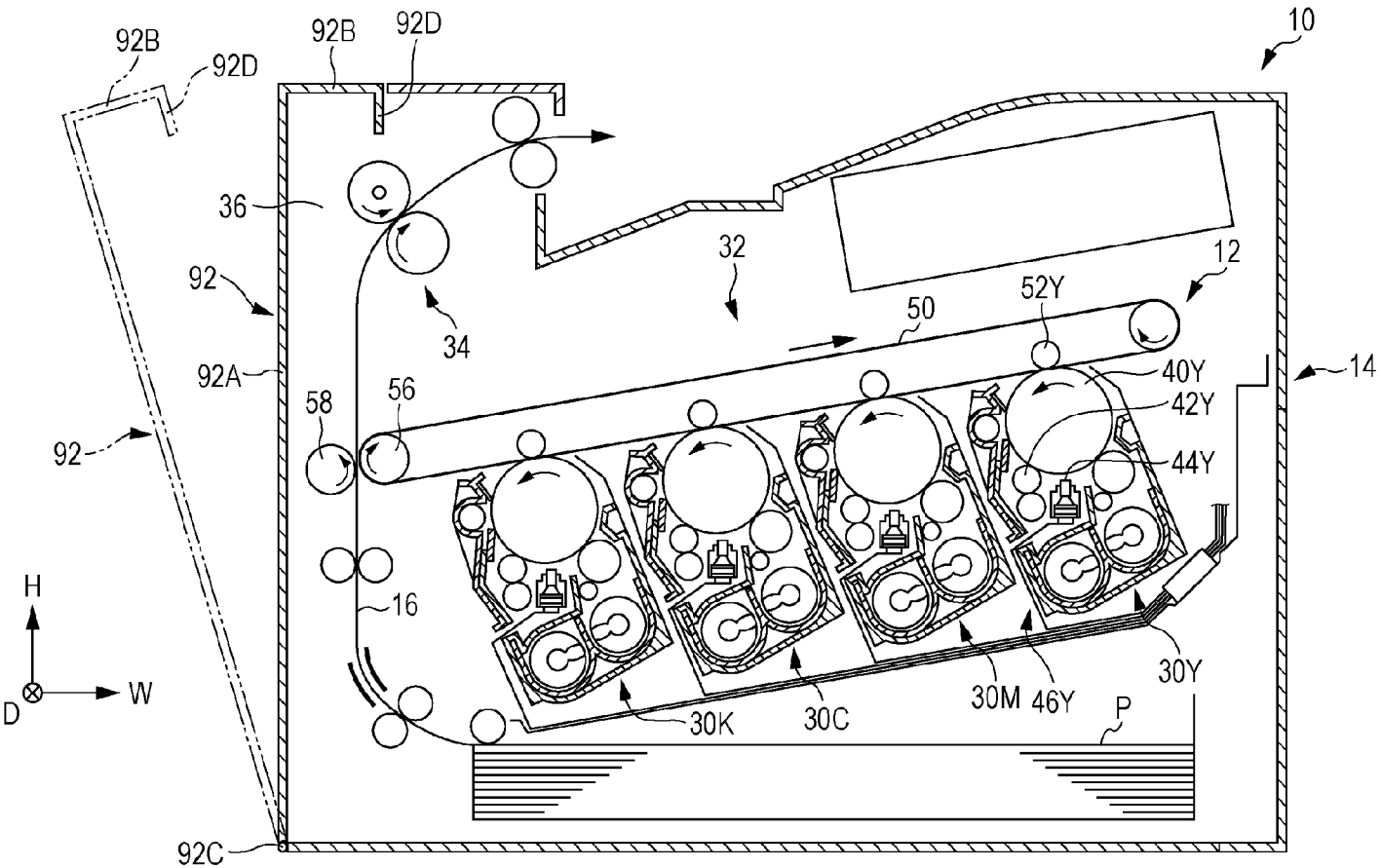
FIG. 5 is a schematic diagram illustrating the image forming apparatus according to the exemplary embodiment of the present invention.

As illustrated in FIG. 5, an image forming apparatus 10 includes an image forming unit 12 (example of an image forming member) that forms a toner image (example of an image) by an electrophotographic method, and plural transport members (reference numerals omitted) that transport a sheet member P (example of a recording medium), on which the toner image is formed, along a transport path 16 of the sheet member P. The image forming apparatus 10 also includes a housing 14 that houses functional members.

The image forming unit 12 includes plural toner-image forming units 30Y, 30M, 30C, and 30K that form toner images of respective colors, and a transfer unit 32 that transfers the toner images formed by the toner-image forming units 30 onto the sheet member P. The image forming unit 12 also includes a fixing device 34 that fixes the toner images that have been transferred onto the sheet member P by the transfer unit 32 to the sheet member P. In the present exemplary embodiment, four toner-image forming units 30 for the respective colors, which are yellow (Y), magenta (M), cyan (C), and black (K), are provided. In each figure, (Y), (M), (C), and (K) represent the respective colors. The fixing device 34 and an opening-closing member 92, which opens a fixing space 36 that accommodates the fixing device 34 to the outside, will be described in detail below.

The toner-image forming units 30Y, 30M, 30C, and 30K of the respective colors are arranged along a transfer belt 50, which is included in the transfer unit 32 and rotates, in a direction at an angle with respect to the width direction of the apparatus. The yellow (Y), magenta (M), cyan (C), and black (K) toner-image forming units 30 are arranged in that order from an upstream side in the direction in which the transfer belt 50 rotates (direction shown by the arrow in FIG. 5). In the following description, the characters Y, M, C, and K attached to the reference numerals will be omitted when it is not necessary to distinguish between yellow (Y), magenta (M), cyan (C), and black (K).

The toner-image forming units 30 of the respective colors basically have similar structures except for the toner used therein, and each toner-image forming unit 30 includes a cylindrical photoconductor drum 40 that rotates and a charging device 42 that charges the photoconductor drum 40. Each toner-image forming unit 30 further includes an exposure device 44 that forms an electrostatic latent image by irradiating the charged photoconductor drum 40 with exposure light, and a developing device 46 that develops the electrostatic latent image into a toner image by using developer G including the toner. The photoconductor drum 40 of each color is in contact with the transfer belt 50 that rotates.

The transfer unit 32 includes the transfer belt 50 that is wrapped around plural rollers (not shown) and rotates in the direction shown by the arrow, and first transfer rollers 52 arranged so as to oppose the photoconductor drums 40 of the respective colors with the transfer belt 50 interposed therebetween. The first transfer rollers 52 transfer the toner images formed on the photoconductor drums 40 onto the transfer belt 50.

The transfer unit 32 further includes an auxiliary roller 56 around which the transfer belt 50 is wrapped, and a second transfer roller 58 that opposes the auxiliary roller 56 with the transfer belt 50 interposed therebetween and that transfers the toner images on the transfer belt 50 onto the sheet member P.

In each of the toner-image forming units 30 of the respective colors included in the image forming apparatus 10 having the above-described structure, the charging device 42 charges the photoconductor drum 40 that rotates, and the exposure device 44 forms an electrostatic latent image by irradiating the charged photoconductor drum 40 with the exposure light. In addition, the developing device 46 develops the electrostatic latent image formed on the photoconductor drum 40 into a toner image with the developer G.

In the transfer unit 32, the first transfer rollers 52 of the respective colors transfer the toner images formed on the photoconductor drums 40 of the respective colors onto the transfer belt 50, and the second transfer roller 58 transfers the toner images on the transfer belt 50 onto the sheet member P that is transported along the transport path 16. The toner images are fixed to the sheet member P by the fixing device 34. The sheet member P to which the toner images are fixed is further transported along the transport path 16, and is ejected to the outside of the apparatus.

Basic Structure

The fixing device 34 and the opening-closing member 92 will now be described. The opening-closing member 92 is an example of a moving member that opens the fixing space 36, which is an example of a space that accommodates the fixing device 34, to the outside.

Fixing Device

As illustrated in FIG. 1A, the fixing device 34 includes a heating roller 60 as an example of a heating member and an opposing roller 62 as an example of an opposing member. The heating roller 60 heats the toner images. The opposing roller 62 opposes the heating roller 60 at an upper side of the heating roller 60. The image forming apparatus 10 is relatively small. Therefore, as illustrated in FIG. 5, the sheet member P is transported upward along the opening-closing member 92, which will be described below. Then, the direction in which the sheet member P is transported is changed to the width direction of the apparatus in an upper section of the housing 14 so that the sheet member P is ejected onto the top surface of the housing 14. Accordingly, the fixing device 34, which is disposed at a downstream position of the transport path 16 of the sheet member P, is disposed in the upper section of the housing 14. The surface of the sheet member P on which the images are formed faces downward at the position where the direction in which the sheet member P is transported is changed to the width direction of the apparatus. Therefore, the heating roller 60 is disposed at a lower side of the opposing roller 62. In other words, the opposing roller 62 is disposed at an upper side of the heating roller 60.

As illustrated in FIG. 1A, the fixing device 34 further includes a support unit 70 that supports the heating roller 60 and the opposing roller 62, and a spring member 80, which is an example of an urging member. The spring member 80 urges the opposing roller 62 toward the heating roller 60 so that the opposing roller 62 presses the sheet member P against the heating roller 60. The fixing device 34 further includes a cancelling lever 86 as an example of a cancelling member. The cancelling lever 86 cancels the pressing force (hereinafter referred to also as "nipping force") with which the opposing roller 62 presses the sheet member P against the heating roller 60.

Heating Roller

The heating roller 60 includes a cylindrical member 60A made of a metal and a heating element 60B disposed in the cylindrical member 60A. The heating roller 60 is arranged such that the axial direction thereof is the depth direction of the apparatus. The heating roller 60 rotates in the direction shown by the arrow in FIG. 1A (clockwise) when a rotational force is transmitted thereto from a motor.

Opposing Roller

The opposing roller 62 includes a columnar shaft member 62A and a cylindrical elastic member 62B through which the shaft member 62A extends and that is formed of an elastically deformable rubber member. The opposing roller 62 is arranged such that the axial direction thereof is the depth direction of the apparatus. The outer peripheral surface of the elastic member 62B is in contact with the outer peripheral surface of the heating roller 60.

Support Unit

The support unit 70 is provided at each side of the apparatus in the depth direction to support the heating roller 60 and the opposing roller 62. Each support unit 70 includes a support member 72 as an example of a second support member and a support member 74 as an example of a first support member. The support member 72 supports the heating roller 60 with a bearing 78 provided therebetween, and is attached to a frame member (not shown) arranged in the housing 14. The support member 74 supports the opposing roller 62 with a bearing (not shown) provided therebetween. The support member 74 is rotatably supported on the support member 72 by a shaft member 76. The shaft member 76 is arranged such that the axial direction thereof is the depth direction of the apparatus, and is disposed on the right side of the heating roller 60 in FIG. 1A.

Figure 4:
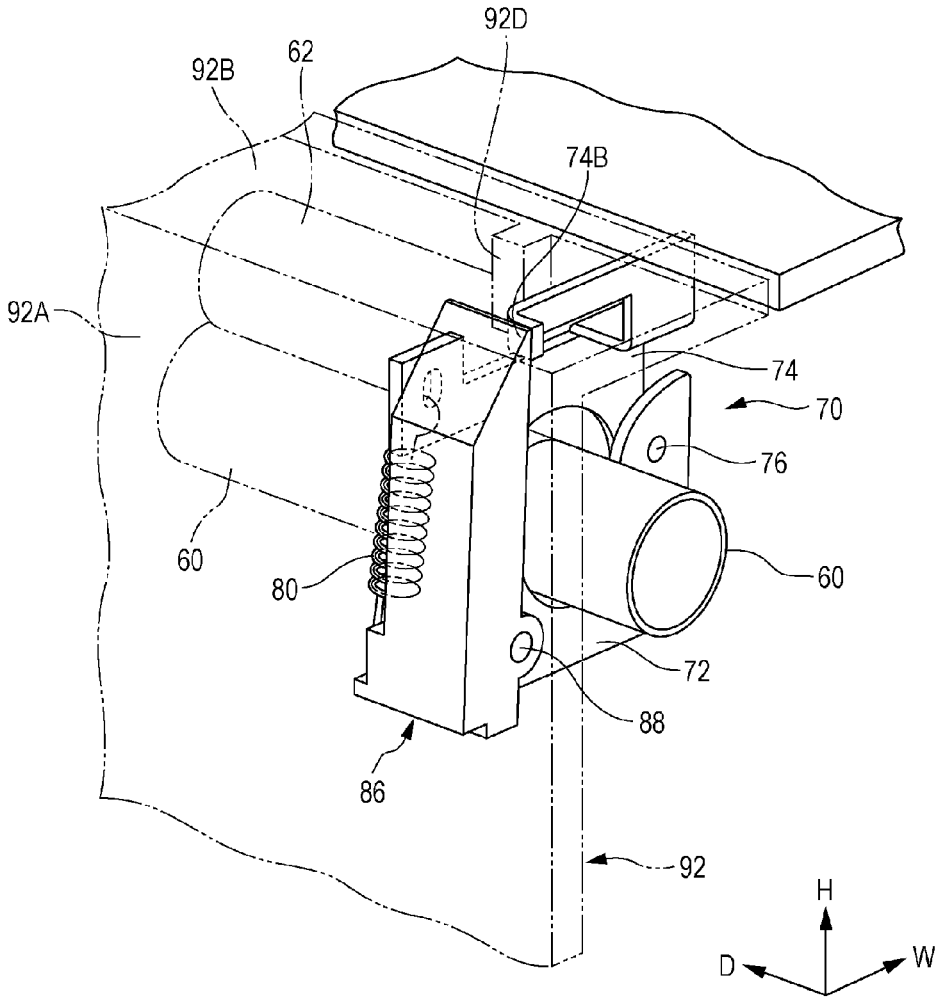
FIG. 4 is a perspective view illustrating a cancelling lever, the fixing device, etc., included in the image forming apparatus according to the exemplary embodiment of the present invention.

As illustrated in FIGS. 1A and 4, a restricting portion 74B that restricts rotation of the cancelling lever 86, which will be described below, is formed on the support member 74 in an upper section of the support member 74 that supports the opposing roller 62.

Spring Member

The spring member 80 is a tension spring. As illustrated in FIG. 1A, when viewed in the depth direction of the apparatus, the spring member 80 is disposed so as to face the shaft member 76 with the heating roller 60 disposed therebetween, and extends in the up-down direction of the apparatus. The top end (one end) of the spring member 80 is inserted through and attached to a long hole 74A that is formed in the support member 74 so as to extend in the up-down direction. The bottom end (the other end) of the spring member 80 is inserted through and attached to an attachment hole 86A formed in the cancelling lever 86, which will be described below. In this state, the length of the spring member 80 is greater than the free length of the spring member 80.

Cancelling Lever

The cancelling lever 86 is long, and is rotatably attached to the support member 72 by a shaft portion 88 at a proximal end portion thereof. The support member 72 is arranged such that the axial direction thereof is the depth direction of the apparatus. The attachment hole 86A, to which the bottom end of the spring member 80 is attached as described above, is formed in the cancelling lever 86 at a position below the shaft portion 88.

Figure 3:
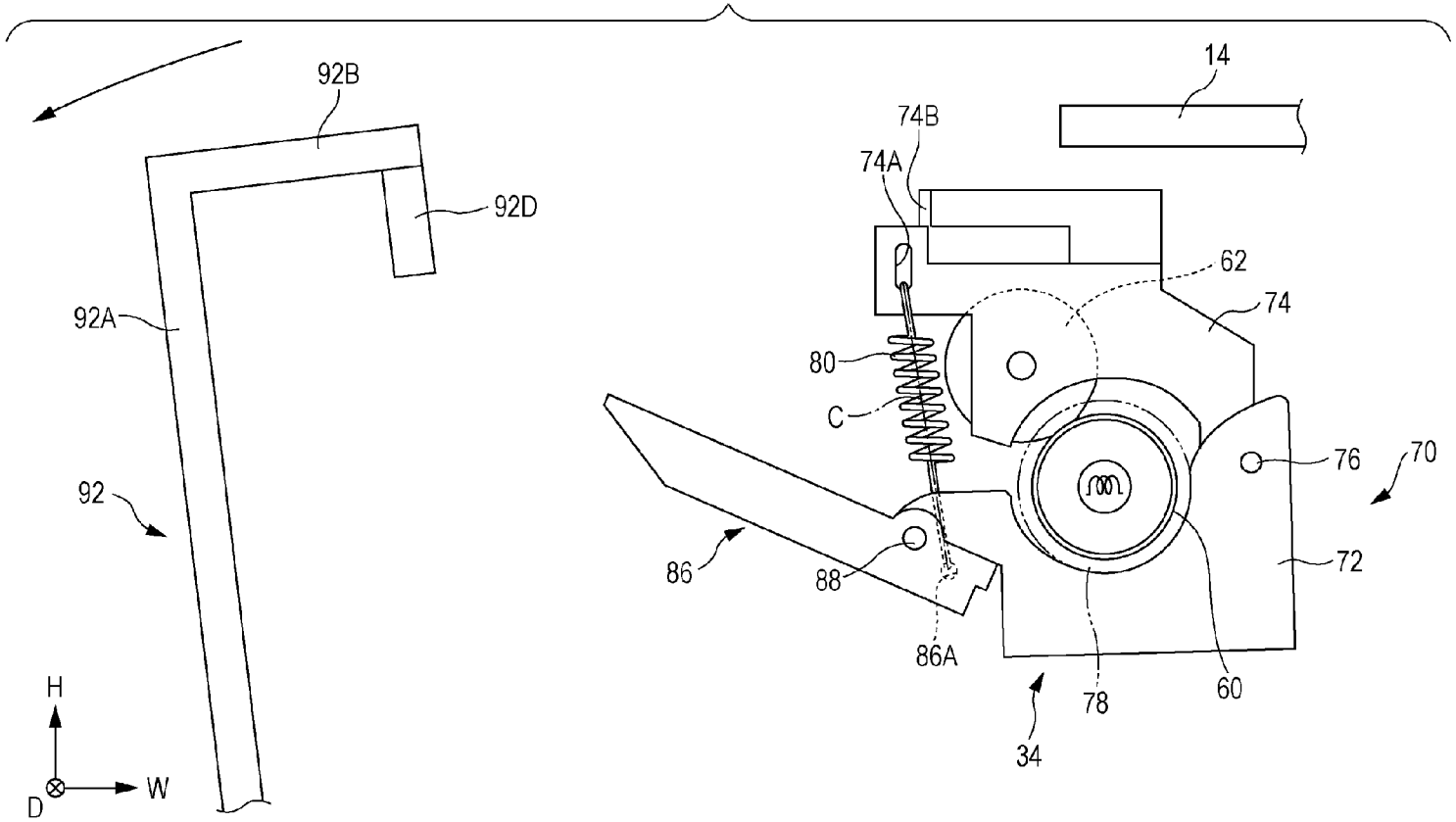
FIG. 3 is a side view illustrating the opening-closing member, the fixing device, etc., included in the image forming apparatus according to the exemplary embodiment of the present invention.

The cancelling lever 86 may be rotated around the shaft portion 88 to a first reference position (see FIG. 1(A)) or a second reference position (see FIG. 3). At the first reference position, a distal end portion of the cancelling lever 86 comes into contact with the restricting portion 74B from the left side in FIG. 1A (from the opening-closing-member-92 side), so that clockwise rotation of the cancelling lever 86 is restricted. At the second reference position, the cancelling lever 86 comes into contact with a restricting member (not shown), so that counterclockwise rotation of the cancelling lever 86 is restricted.

In the state in which the cancelling lever 86 is at the first reference position, as illustrated in FIG. 1A, when viewed in the depth direction of the apparatus, the distal end portion of the cancelling lever 86 is located above the proximal end portion of the cancelling lever 86, and the cancelling lever 86 extends in the up-down direction of the apparatus. In addition, the line segment C that connects the top and bottom ends of the spring member 80 is at the left side (one side) of the shaft portion 88 in FIG. 1A.

With this structure, in the state in which the cancelling lever 86 is at the first reference position, the cancelling lever 86 receives a clockwise rotational force due to the urging force of the spring member 80. The distal end portion of the cancelling lever 86 comes into contact with the restricting portion 74B from the opening-closing-member-92 side, so that clockwise rotation of the cancelling lever 86 is restricted. In addition, when the cancelling lever 86 is at the first reference position, the spring member 80 urges the opposing roller 62 toward the heating roller 60 so that the opposing roller 62 is set to a pressing state in which the opposing roller 62 presses the sheet member P against the heating roller 60.

More specifically, the urging force of the spring member 80 is transmitted to the support member 74, which supports the opposing roller 62, from the support member 72, which supports the heating roller 60, through the shaft portion 88 and the cancelling lever 86. Thus, the opposing roller 62 is set to the pressing state.

When the cancelling lever 86 disposed at the first reference position is rotated counterclockwise, the cancelling lever 86 comes into contact with the restricting member (not shown), and is positioned at the second reference position. In the state in which the cancelling lever 86 is at the second reference position, as illustrated in FIG. 3, the cancelling lever 86 is tilted such that the distal end portion thereof is above and on the opening-closing-member-92 side of the proximal end portion thereof.

The line segment C that connects the top and bottom ends of the spring member 80 is at the right side (the other side) of the shaft portion 88 in FIG. 3. In the state in which the cancelling lever 86 is at the second reference position, the attachment hole 86A formed in the cancelling lever 86 is located above the position of the attachment hole 86A in the state in which the cancelling lever 86 is at the first reference position. Therefore, in the state in which the cancelling lever 86 is at the second reference position, the line length of the spring member 80 (length of the spring member 80) is smaller than that in the state in which the cancelling lever 86 is at the first reference position.

With this structure, in the state in which the cancelling lever 86 is at the second reference position, the cancelling lever 86 receives a counterclockwise rotational force due to the urging force of the spring member 80. The cancelling lever 86 comes into contact with the restricting member (not shown), so that rotation of the cancelling lever 86 is restricted. In addition, when the cancelling lever 86 is at the second reference position, the line length of the spring member 80 is reduced, and the opposing roller 62 is set to a canceled state in which the nipping force thereof is canceled. The canceled state is a state in which the nipping force is weakened or reduced to 0 from that in the pressing state in which the sheet member P is pressed against the heating roller 60 by the opposing roller 62.

Opening-Closing Member

As illustrated in FIG. 5, the opening-closing member 92 constitutes a portion of the housing 14, and covers a side (left side in FIG. 5) of the fixing space 36 in which the fixing device 34 is disposed. When the sheet member P is jammed between the opposing roller 62 and the heating roller 60, the user inserts his or her hand into the fixing space 36 to remove the jammed sheet member P.

The opening-closing member 92 includes a vertical plate 92A having plate surfaces that face the width direction of the apparatus, an upper plate 92B having a proximal end that is connected to the top end of the vertical plate 92A and plate surfaces that face the up-down direction, and a shaft portion 92C that is disposed at the bottom end of the vertical plate 92A and extends in the depth direction of the apparatus.

Figure 1B:
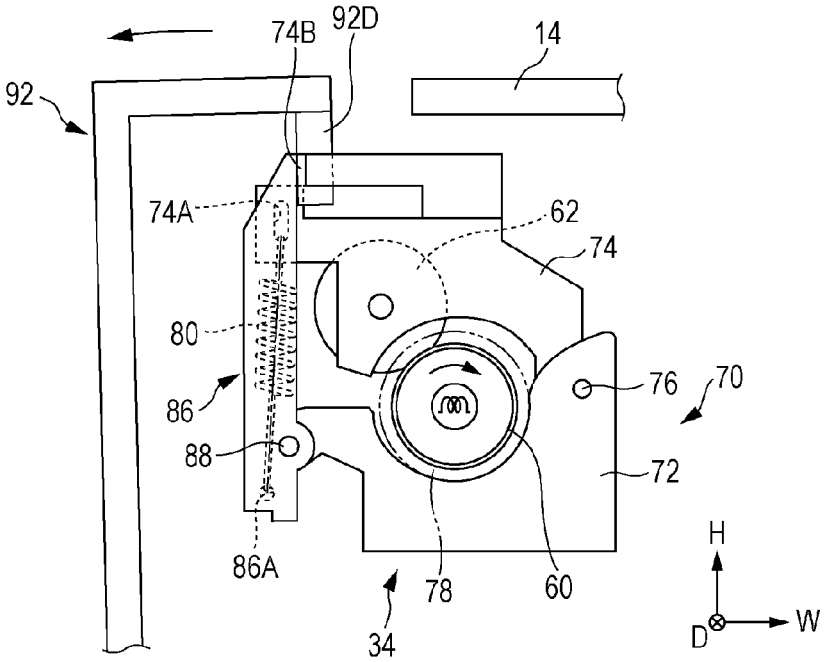

As illustrated in FIGS. 1A, 1B, and 4, in the state in which the cancelling lever 86 is at the first reference position, a projecting portion 92D is provided on the right side (restricting-portion-74B side) of the distal end portion of the cancelling lever 86 in FIGS. 1A and 1B. The projecting portion 92D projects downward from a distal end of the upper plate 92B, and is separated from the cancelling lever 86 in the width direction of the apparatus.

In this structure, the opening-closing member 92 rotates (moves) around the shaft portion 92C between a closed position (shown by the solid lines in FIG. 5), at which the opening-closing member 92 covers the fixing space 36 at a side of the housing 14, and an open position (shown by the two-dot chain lines in FIG. 5), at which the opening-closing member 92 opens the fixing space 36 to the outside at the side of the housing 14.

The structure (steps) for cancelling the nipping force in response to a rotation of the opening-closing member 92 from the closed position to the open position will now be described together with the operation.

Operation

Next, an operation of removing a sheet member P when the sheet member P is jammed between the opposing roller 62 and the heating roller 60 (in a fixing nip portion) will be described. When a paper jam occurs, the opening-closing member 92 is at the closed position. In addition, the cancelling lever 86 is at the first reference position, and the opposing roller 62 is set to the pressing state in which the opposing roller 62 presses the sheet member P against the heating roller 60.

In the case where the sheet member P is jammed between the opposing roller 62 and the heating roller 60, first, as illustrated in FIGS. 1A and 1B, the user rotates the opening-closing member 92, which is at the closed position, around the shaft portion 92C (see FIG. 5). Accordingly, the projecting portion 92D provided on the opening-closing member 92 is also rotated, and the projecting portion 92D comes into contact with the distal end portion of the cancelling lever 86, which is at the first reference position.

Figure 2:
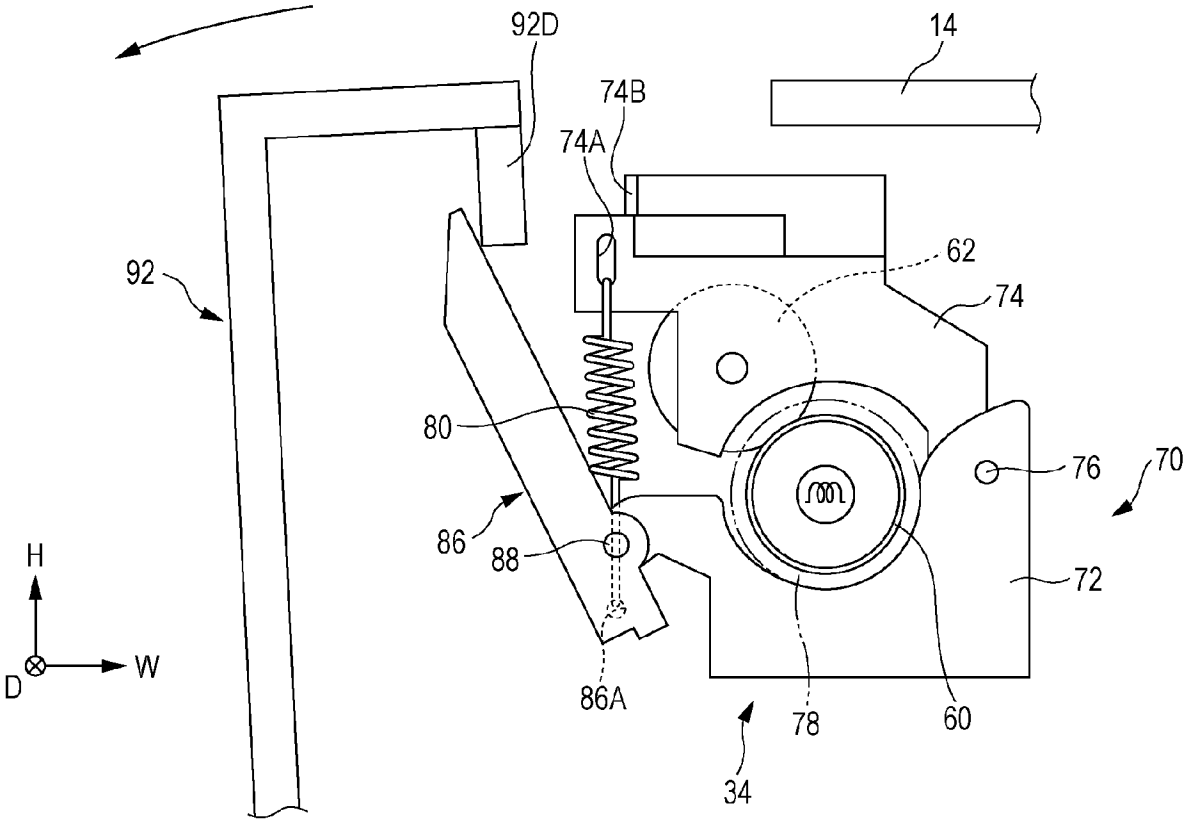
FIG. 2 is a side view illustrating the opening-closing member, the fixing device, etc., included in the image forming apparatus according to the exemplary embodiment of the present invention.

When the user further rotates the opening-closing member 92, as illustrated in FIG. 2, the projecting portion 92D pushes the distal end portion of the cancelling lever 86, and the cancelling lever 86 rotates counterclockwise around the shaft portion 88. When the cancelling lever 86 rotates, the bottom end of the spring member 80 also rotates. Accordingly, when viewed in the depth direction of the apparatus, the cancelling lever 86 reaches a so-called dead point at which the top end of the spring member 80, the shaft portion 88, and the bottom end of the spring member 80 are aligned (point at which the cancelling lever 86 does not receive a moment of rotation). In this state, the line length of the spring member 80 is at a maximum.

When the user further rotates the opening-closing member 92, the opening-closing member 92 comes into contact with a restricting member (not shown), and stops at the open position, as illustrated in FIG. 3. At this time, since the distal end portion of the cancelling lever 86 is pushed by the projecting portion 92D, the position of the attachment hole 86A is also moved. Accordingly, the cancelling lever 86 is released from the dead point, and receives a counterclockwise rotational force due to the urging force of the spring member 80. As a result, the cancelling lever 86 rotates counterclockwise around the shaft portion 88, and stops at the second reference position when the cancelling lever 86 comes into contact with the restricting member.

As described above, in the state in which the cancelling lever 86 is at the second reference position, the cancelling lever 86 is tilted such that the distal end portion thereof is above the proximal end portion thereof. In addition, the opposing roller 62 is set to the canceled state in which the nipping force is canceled.

In this state, the user inserts his or her hand into the fixing space 36 from the open side of the housing 14, and removes the jammed sheet member P. Since the nipping force is canceled, the sheet member P may be more easily removed compared to the case in which the nipping force is not cancelled.

After the jammed sheet member P is removed, the user rotates the opening-closing member 92, which is at the open position, around the shaft portion 92C to the closed position. At this time, the distal end portion of the cancelling lever 86 is pressed by the back surface of the vertical plate 92A of the opening-closing member 92, so that the cancelling lever 86 is rotated clockwise around the shaft portion 88. Accordingly, the cancelling lever 86 is pressed by the back surface of the vertical plate 92A, passes through the above-described dead point, and stops at the first reference position when the cancelling lever 86 comes into contact with the restricting portion 74B.

Thus, the process of removing the sheet member P is completed.

SUMMARY

As described above, in the case where a sheet member is jammed between the opposing roller 62 and the heating roller 60, when the opening-closing member 92 disposed at the closed position is rotated toward the open position, the nipping force is cancelled.

Figure 6A:
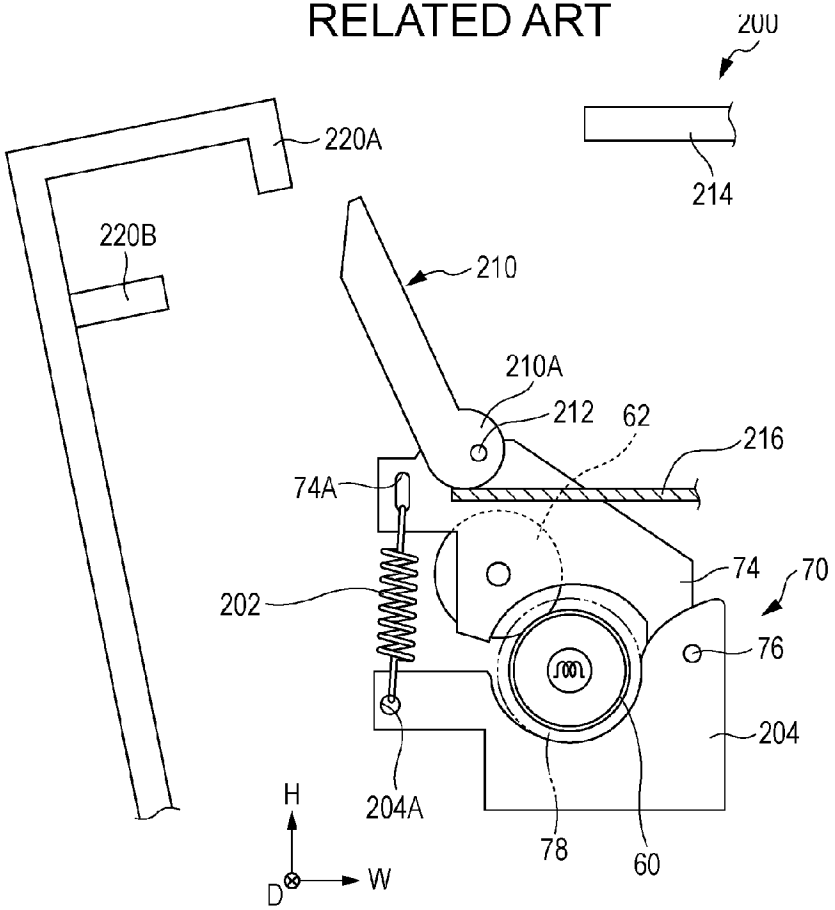
FIG. 6A RELATED ART
FIGS. 6A and 6B are side views illustrating an opening-closing member, a fixing device, etc., included in an image forming apparatus according to the related art to be compared to the exemplary embodiment of the present invention.
Figure 6B:
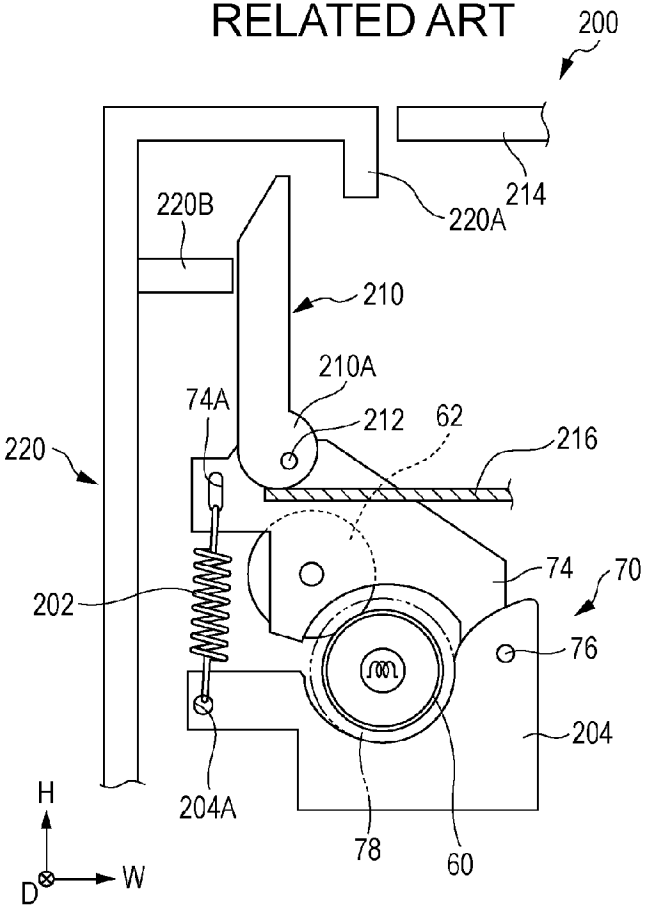
FIG. 6B RELATED ART

Here, an image forming apparatus 200 according to the related art to be compared with the image forming apparatus 10 according to the present exemplary embodiment will be described with reference to FIGS. 6A and 6B. Components similar to those of the image forming apparatus 10 according to the present exemplary embodiment are denoted by the same reference numerals, and descriptions thereof are thus omitted. Differences from the present exemplary embodiment will be described. The opposing roller 62 is in the pressing state in FIG. 6A, and is in the cancelled state in FIG. 6B.

In the image forming apparatus 200 according to the related art, the bottom end of a spring member 202 is inserted into an attachment hole 204A formed in a support member 204 that supports a heating roller 60.

A cancelling lever 210 is long, and is rotatably attached to a support member 74 by a shaft portion 212 at a proximal end portion thereof. The shaft portion 212 is arranged such that the axial direction thereof is the depth direction of the apparatus. The cancelling lever 210 is movable between the pressing position (see FIG. 6A) and the cancelling position (see FIG. 6B), and the rotational range thereof is restricted by restricting members (not shown).

More specifically, the cancelling lever 210 includes an eccentric cam 210A on the proximal end portion thereof. The outer peripheral surface of the eccentric cam 210A is pressed against the top surface of a frame 216, which is attached to a housing 214 and has plate surfaces that face the up-down direction, by the urging force of the spring member 202. A distal end portion of the cancelling lever 210 extends upward.

When the cancelling lever 210 is at the pressing position, the opposing roller 62 is set to the pressing state. When the cancelling lever 210 is at the cancelling position, the support member 74 is raised by the eccentric cam 210A, and the opposing roller 62 is set to the cancelled state.

An opening-closing member 220 includes a projection 220A and a projection 220B. The projection 220A pushes the distal end portion of the cancelling lever 210 at the pressing position, and the projection 220B pushes the distal end portion of the cancelling lever 210 at the cancelling position, in response to the opening-closing movement of the opening-closing member 220.

In the image forming apparatus 200 according to the related art, the height of the housing 214 is determined by the position of the distal end portion of the cancelling lever 210.

In contrast, in the image forming apparatus 10 according to the present exemplary embodiment, the cancelling lever 86 is supported on the support member 72, which supports the heating roller 60, by the shaft portion 88. Accordingly, in the structure in which the opposing roller 62 is disposed above the heating roller 60, compared to the image forming apparatus 200 according to the related art, the amount by which the distal end portion of the cancelling lever 86 projects upward from the opposing roller 62 is reduced. As a result, the structure in which the height of the housing 14 may be reduced is provided.

In addition, when the opening-closing member 92 disposed at the closed position is rotated to the open position, the cancelling lever 86 that has been disposed at the first reference position is rotated to the second reference position.

In the state in which the cancelling lever 86 is at the first reference position, the line segment C that connects the top and bottom ends of the spring member 80 is on the left side of the shaft portion 88 in FIG. 1A. In the state in which the cancelling lever 86 is at the second reference position, the line segment C that connects the top and bottom ends of the spring member 80 is on the right side of the shaft portion 88 in FIG. 3. In other words, in the case where the cancelling lever 86 disposed at the first reference position is rotated to the second reference position, when viewed in the depth direction of the apparatus, the cancelling lever 86 passes through the dead point at which the top end of the spring member 80, the shaft portion 88, and the bottom end of the spring member 80 are aligned. When the cancelling lever 86 is at the dead point, the line length of the spring member 80 is at a maximum. Accordingly, when the opening-closing member 92 disposed at the closed position is rotated, the operational load temporarily increases, and then decreases (is eliminated). Therefore, unlike the case in which the operational load is constant while the opening-closing member 92 is being rotated from the closed position to the open position, a tactile feel may be provided.

When the distal end portion of the cancelling lever 86 comes into contact with the restricting portion 74B formed on the support member 74 that supports the opposing roller 62, rotation of the cancelling lever 86 is restricted, and the cancelling lever 86 is disposed at the first reference position. Therefore, compared to the case in which the restricting portion that restricts the rotation of the cancelling lever 86 is provided on the housing, variation in the position of the cancelling lever 86 with respect to the opposing roller 62 may be reduced. Accordingly, variation in the nipping force may be reduced.

Although a specific exemplary embodiment of the present invention has been described in detail, the present invention is not limited to the above-described exemplary embodiment, and it is obvious to a person skilled in the art that various modifications are possible within the scope of the present invention. For example, although the opposing roller 62 is used as an opposing member and the heating roller 60 is used as a heating member in the above-described exemplary embodiment, an opposing member of a belt type, for example, may be used instead of the roll-type opposing member.

In addition, in the above-described exemplary embodiment, when the opening-closing member 92 disposed at the closed position is rotated, the projecting portion 92D pushes the cancelling lever 86 to rotate the cancelling lever 86. Alternatively, however, the projecting portion 92D may pull the cancelling lever 86 to rotate the cancelling lever 86.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming member that forms an image on a recording medium;

a heating member that is disposed in a housing and heats the image formed on the recording medium;

an opposing member that opposes the heating member at an upper side of the heating member;

an urging member having one end attached to a first support member that supports the opposing member, the urging member urging the opposing member toward the heating member so that the opposing member presses the recording medium against the heating member;

a moving member that forms a portion of the housing and moves from a closed position to an open position, a space accommodating the heating member and the opposing member being closed at one side of the housing when the moving member is at the closed position and opened at the one side of the housing when the moving member is at the open position; and a cancelling member to which the other end of the urging member is attached and that is rotatably attached to a second support member that supports the heating member, the cancelling member rotating in response to the movement of the moving member from the closed position to cancel a pressing force with which the opposing member presses the recording medium against the heating member.

2. The image forming apparatus according to claim 1, wherein the heating member rotates around a rotational axis that extends in a certain direction, wherein, in a state in which the moving member is at the closed position, when viewed in the certain direction, a line segment that connects the ends of the urging member is on one side of a shaft portion with which the cancelling member is rotatably attached to the second support member, and wherein, in a state in which the moving member is at the open position, when viewed in the certain direction, the line segment is on the other side of the shaft portion.

3. The image forming apparatus according to claim 2, wherein the first support member includes a restricting portion that comes into contact with the cancelling member and restricts rotation of the cancelling member in a pressing state in which the opposing member presses the recording medium against the heating member.

4. The image forming apparatus according to claim 1, wherein the first support member includes a restricting portion that comes into contact with the cancelling member and restricts rotation of the cancelling member in a pressing state in which the opposing member presses the recording medium against the heating member.

* * * * *